US008097832B2

(12) United States Patent
Huang et al.

(10) Patent No.: US 8,097,832 B2
(45) Date of Patent: Jan. 17, 2012

(54) HEATING DEVICE FOR ARTICLE SPECIALLY WORN IN WATER ACTIVITIES

(75) Inventors: Chia-Chin Huang, Taipei (TW); Chiun Tseng, Taipei (TW)

(73) Assignee: Petatech International Co., Ltd, Taipei (TW)

( * ) Notice: Subject to any disclaimer, the term of this patent is extended or adjusted under 35 U.S.C. 154(b) by 659 days.

(21) Appl. No.: 11/834,043

(22) Filed: Aug. 6, 2007

(65) Prior Publication Data

US 2009/0039067 A1 Feb. 12, 2009

(51) Int. Cl.
*H05B 3/00* (2006.01)

(52) U.S. Cl. ..... 219/211; 219/201; 219/527; 607/99

(58) Field of Classification Search ..... 219/211, 219/201–202, 209, 386, 492, 494; 335/205–207; 607/99

See application file for complete search history.

(56) References Cited

U.S. PATENT DOCUMENTS

| | | | | |
|---|---|---|---|---|
| 2,666,583 | A * | 1/1954 | Whitney | 236/1 R |
| 2005/0011879 | A1 * | 1/2005 | Mandell et al. | 219/492 |
| 2006/0060576 | A1 * | 3/2006 | Haas et al. | 219/543 |

FOREIGN PATENT DOCUMENTS

| | | | |
|---|---|---|---|
| FR | 2896766 | A3 * | 8/2007 |

* cited by examiner

*Primary Examiner* — Tu B Hoang
*Assistant Examiner* — Vinod D Patel
(74) *Attorney, Agent, or Firm* — Chun-Ming Shih; HDLS IPR Services

(57) ABSTRACT

A heating device for an article specially worn in the water activities includes a magnetic unit, a power source unit, an inductive unit, a control unit, a heating unit, and a display unit. In this device, the magnetic unit is to generate a magnetic output. The power source unit is to provide a power source needed by the device. The inductive unit, induced by the magnetic force of the magnetic unit, generates an inductive signal output. The control unit, electrically connected to the power source unit and the inductive unit, generates a control signal output by receiving an inductive signal output from the inductive unit. The heating unit is electrically connected to the control unit and is driven by the control signal output from the control unit to process a heating procedure. The display unit is electrically connected to the control unit and is driven by the control signal output from the control unit to display various statuses of the heating device, for example, actuation, shutdown or values of temperature.

4 Claims, 6 Drawing Sheets

HEATING DEVICE FOR ARTICLE SPECIALLY WORN IN WATER ACTIVITIES

BACKGROUND OF THE INVENTION

1. Field of the Invention

The present invention generally relates to a heating device, and in particular, to a heating device for an article specially worn in water activities.

2. Description of Prior Art

Water activities have become a recreating choice indispensable in generally recreating vocation. For various water activities, some people prefer the activities on water surface, for example, water motorcycle, banana ship, and windsurfing, etc., while some other prefer the activities under water, for example, diving and snorkeling. However, during the water diving activity, all divers have to wear a diving suit, which is not only for preventing the diver's skin from being stung, bitten, and/or contacted by dangerous organism, but also for keeping the diver from losing body's temperature and heat during diving. The thickness of a diving suit is usually around 3 mm~5 mm to keep out the cold in a diving.

Although a diving suit may keep warm during diving, its heat-conserving function will be decayed in corresponding to a quickly lowering down of water temperature if the diver dives deeper and deeper. Under this situation, the diver's body temperature will be also lowered down quickly to cause a lot of body heat loss, probably followed by an occurrence of hazardous unconsciousness. Thereby, some diving suit manufacturers arrange a heating device to the diving suit. The diving suit is distributed with electro-thermal wires (pieces), which may be driven by a heating device to process a heating procedure, and thus the diving suit has a certain degree of warming function. Since the actuating switch of this kind of heating device is extended outside the diving suit, a diver needs to push down the actuating switch to start a heating action, if necessary.

One the other hand, pressure is doubled with every depth increase of 10 meters, and the actuating switch will lose function if the pressure is too large to actuate the switch when the diver is diving deeper and deeper. If the heating device is unable to heat or heat continuously, a physical hazard is probably occurred.

SUMMARY OF THE INVENTION

The invention is to actuate a heating device with a magnetism inducting manner to make a heating action to a wearing article, for example, a diving suit, a glove, a hat, or a life jacket, etc.

The invention is to provide a heating device for article specially worn in the activities on and under water, and the heating device includes a magnetic unit, a power source unit, an inductive unit, a control unit, a heating unit, and a display unit. In this device, the magnetic unit is to generate a magnetic output. The power source unit is to provide a power source needed by the device. The inductive unit, induced by the magnetic force of the magnetic unit, generates an inductive signal output. The control unit, electrically connected to the power source unit and the inductive unit, generates a control signal output by receiving an inductive signal output from the inductive unit, then a timer in the control unit starts counting the magnetism inducing time, which will be compared with a preset time stored in a memory, and a control signal will be output from the control unit if the time is correct. The heating unit is electrically connected to the control unit and is driven by the control signal output from the control unit to process a heating procedure. The display unit is electrically connected to the control unit and is driven by the control signal output from the control unit to display various statuses of the heating device, for example, actuation, shutdown or values of temperature.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE INVENTION

In cooperation with attached drawings, the technical contents and detailed description of the present invention are described thereinafter according to several preferable embodiments, being not used to limit its executing scope. Any equivalent variation and modification made according to appended claims is all covered by the claims claimed by the present invention.

Figure 1:
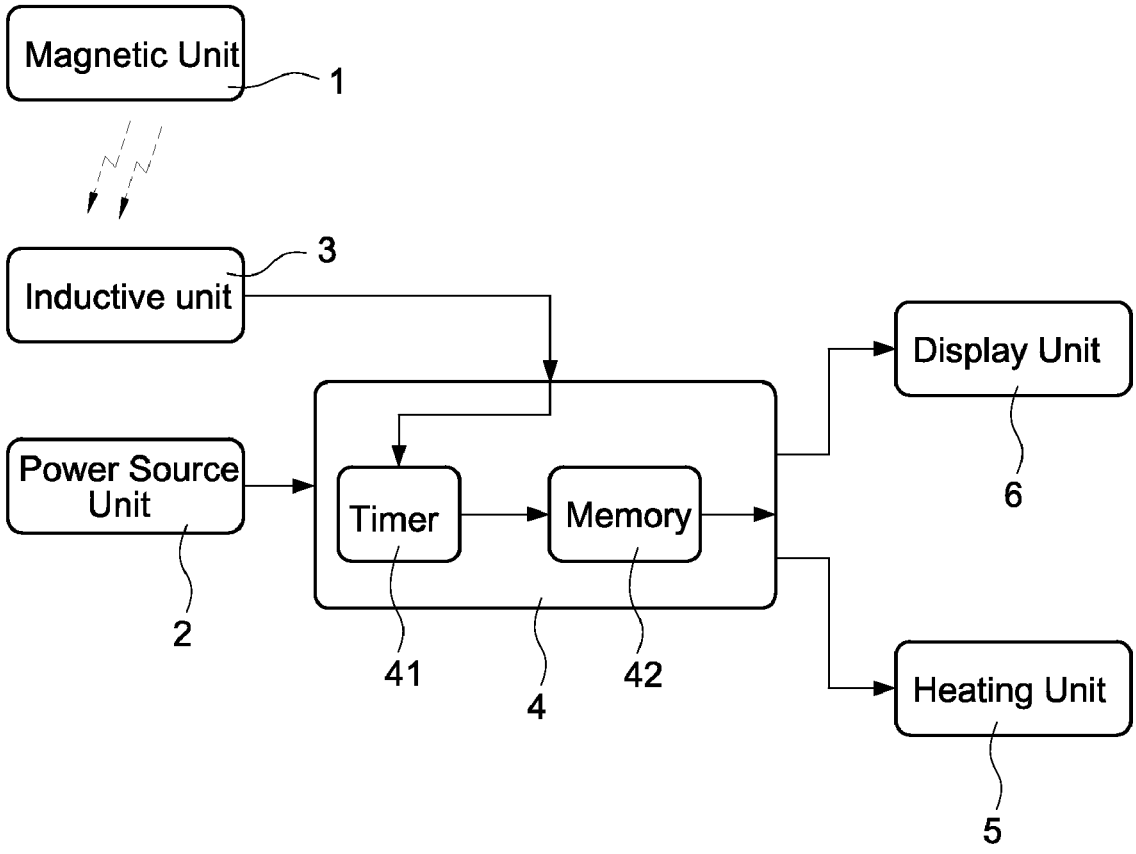
FIG. 1 is a circuit block diagram of the heating device according to the present invention.
Figure 2:
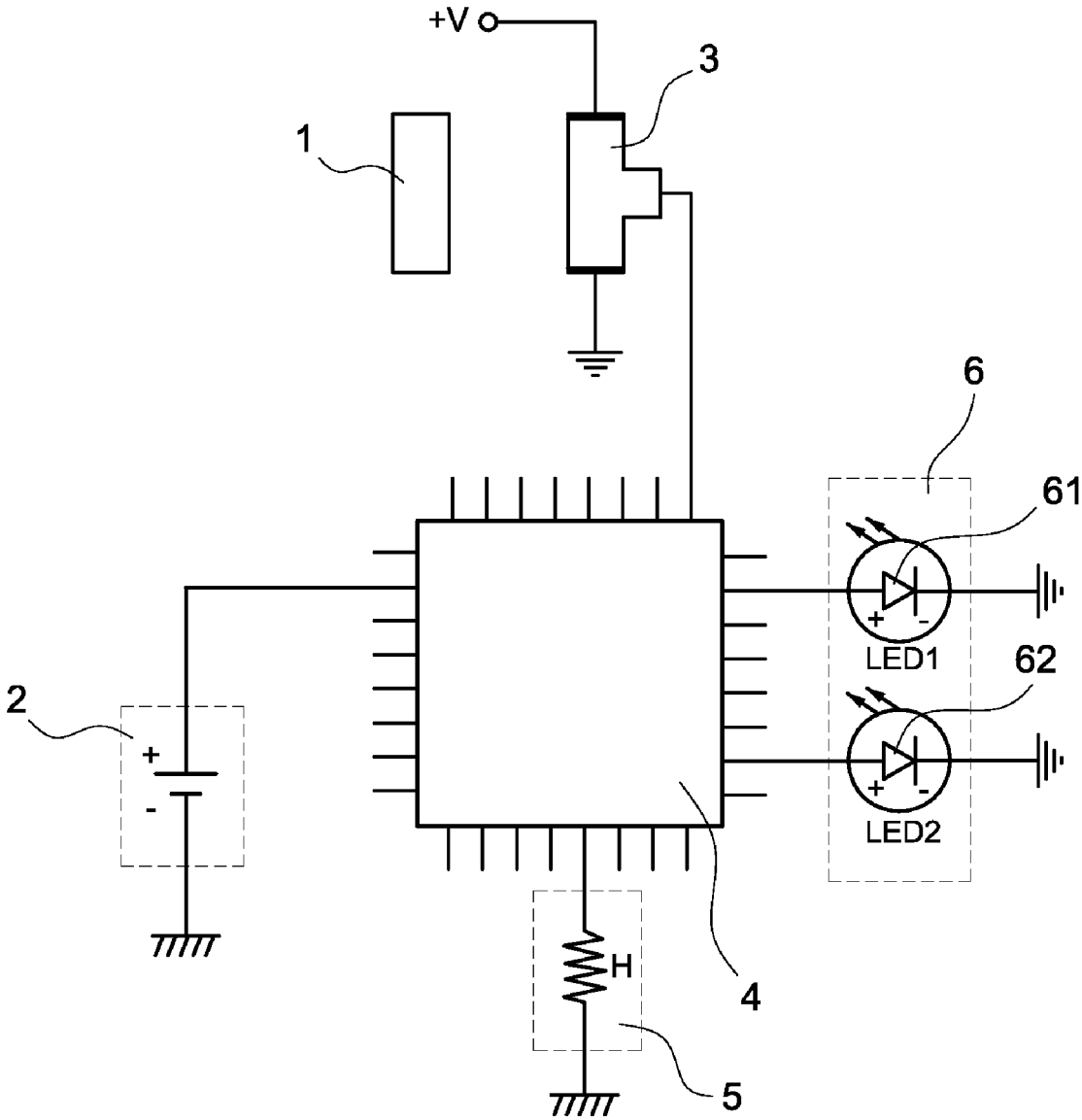
FIG. 2 is a circuit wiring illustration of the heating device according to the present invention.

Please refer to FIG. 1 and FIG. 2, which respectively are a circuit block diagram and a circuit wiring illustration of a heating device according to the present invention. As shown in these figures, a heating device of article specially worn in the activities on and under water includes a magnetic unit 1, a power source unit 2, an inductive unit 3, a control unit 4, a heating unit 5, and a display unit 6. In this device, the magnetic unit 1 is a magnet for generating a magnetic output. The power source unit 2 is a battery for providing a power source needed by the heating device. The inductive unit 3 is a Hall inductive element for being induced by a magnetism output from the magnetic unit 1 to generate an inductive signal output. The control unit 4 is electrically connected to the power source unit 2 and the inductive unit 3 for receiving the inductive signal output from the inductive unit 3 and starts to generate a control signal output if the magnetism inducing time of the inductive unit 3, measured by a timer is identical to a preset time stored in a memory 42 in the control unit 4. In this case, the control unit 4 is a microprocessor. The heating unit 5 is electrically connected to the control unit 4 and is driven by the signal output from the control unit 4 for generating a heating action. The heating unit 5 may be one kind of electro-thermal wire, electro-thermal filament, or electro-thermal piece, all of which can be distributed in glove, hat, clothes, sleeve, or pant. The display unit 6 is electrically connected to the control unit 4 and is composed of one kind or more than two kinds of LED of mono-color or multi-color.

The display unit 6 will display various statuses, for example, the actuation or shutdown of the heating device, or the temperature values of the heating unit 5 after being driven by the signal output from the control unit 4.

Figure 3:
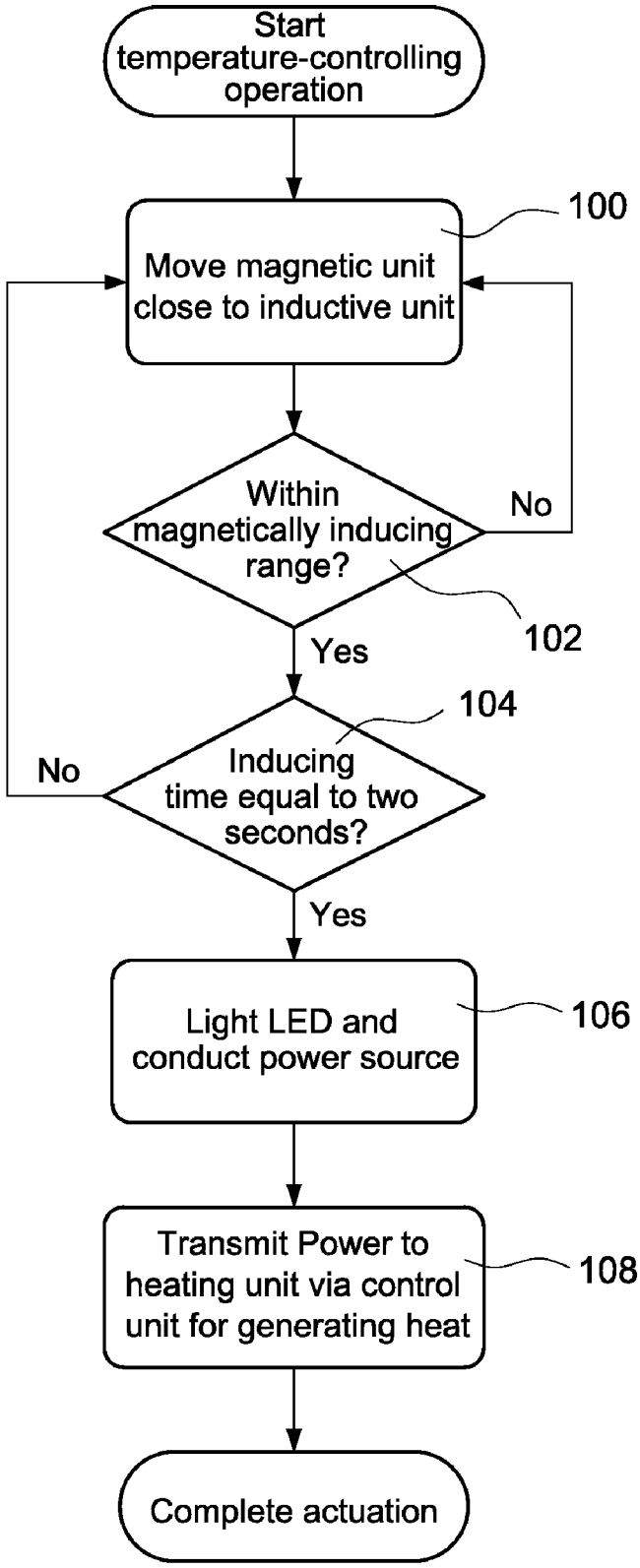
FIG. 3 is a flowchart illustration showing a heating device according to the present invention started to process a heating procedure.

Please refer to FIG. 3 which is a flowchart illustration showing the heating device according to the invention started to process a heating procedure. By the way, FIG. 1 is cooperated herein for reference. Firstly, the magnetic unit 1 is moved toward the inductive unit 3. At step 102, whether the magnetic unit 1 is within the inducing range is determined. If the magnetic amount induced by the inductive unit 3 is too small (i.e., insufficient), then the procedure goes back to step 100. If the magnetic amount induced by the inductive unit 3 becomes bigger when the magnetic unit 1 is closing the magnetic unit 3, then the procedure enters step 104. At step 104, a time for the magnetic unit 1 to close toward the inductive unit 3 is determined whether it is equal to a first predetermined time (e.g., two seconds). If the answer is "yes", then a timer 41 in the control unit 4 will count two seconds, which will be compared to a preset time stored in the memory 42. If the inducing time is less than two seconds, then the procedure goes back to step 100. If the inducing time is equal to two seconds, then the procedure enters step 106 to illuminate an LED lamp 61 (the light source is red). At this time, the power source is conducted, and the procedure enters step 108. At step 108, the power output from the power source 2 is transmitted to the heating unit 5 via the control unit 4, making the heating unit 5 to process a heating action.

Figure 4:
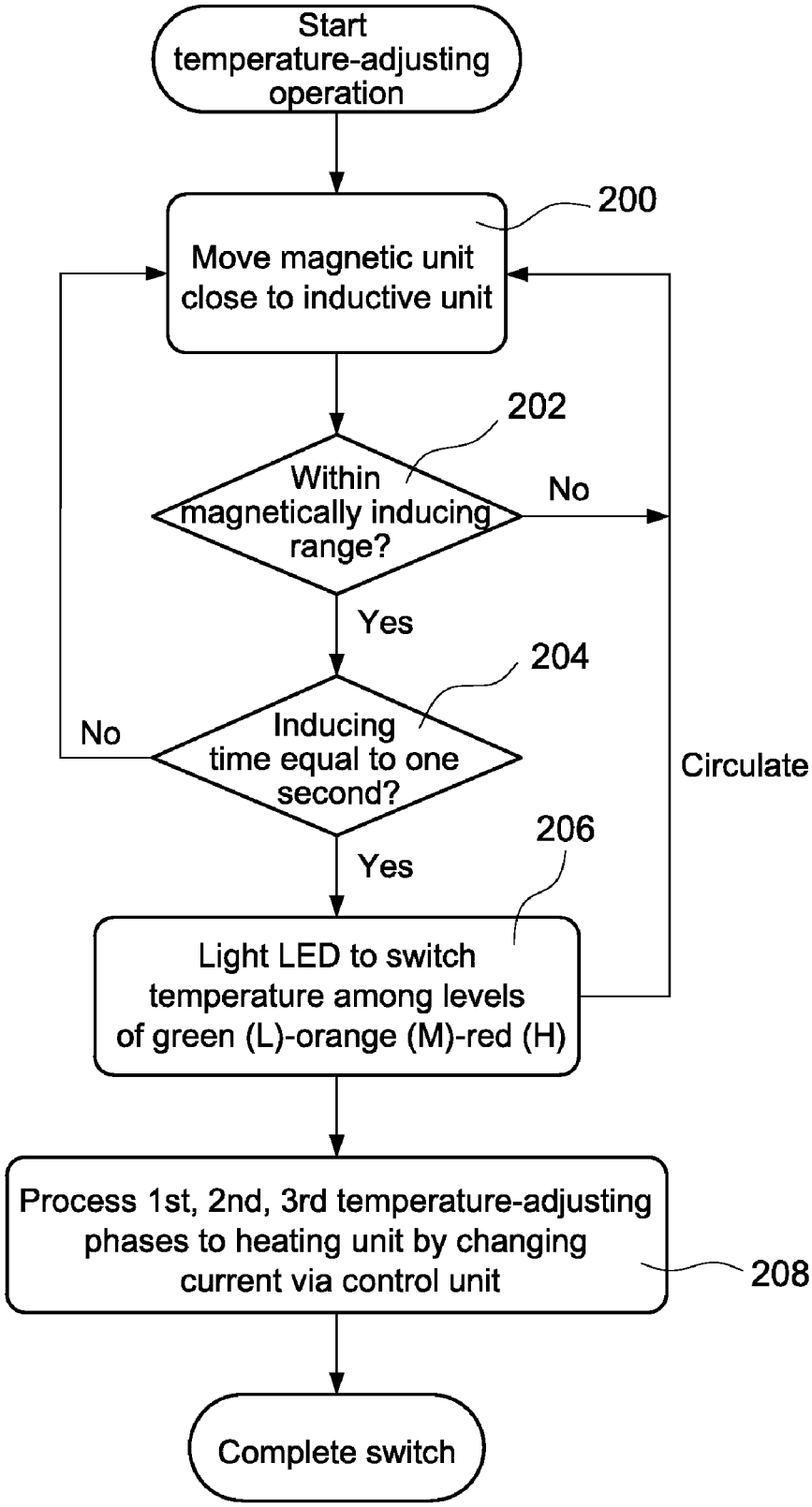
FIG. 4 is a temperature-adjusting flowchart illustration, when a heating device according to the present invention processes a heating procedure.

Please refer to FIG. 4, which is a temperature-adjusting flowchart illustration when a heating device according to the present invention processes a heating procedure. By the way, FIG. 1 and FIG. 2 are cooperated herein for reference. During the heating device being started to use, if the user intends to adjust the heating temperature of the heating unit 4, same as step 100, the magnetic unit 1 is moved toward the inductive unit 3 (step 200). At step 202, whether the magnetic unit 1 is within the inducing range is determined. If the magnetic amount induced by the inductive unit 3 is too small (i.e., insufficient), then the procedure goes back to step 200. If the magnetic amount induced by the inductive unit 3 becomes bigger when the magnetic unit 1 is closing the inductive unit 3, then the procedure enters step 204. At step 204, a time for the magnetic unit 1 to close toward the inductive unit 3 is determined whether it is equal to a second predetermined time (e.g., one second). If the answer is "yes", then the timer 41 in the control unit 4 will count one second, which will be compared to a preset time stored in the memory 42. If the inducing time is less than one second, then the procedure goes back to step 200. If the inducing time is equal to one second, then the procedure enters step 206 to illuminate an LED lamp 62 (the light source is green) for displaying a $1^{st}$ temperature-adjusting level. At this time, the power source is conducted, and the procedure goes to step 208. At step 208, the power output from the power source 2 is transmitted to the heating unit 5 via the control unit 4, making the heating unit 5 to process a heating action on $1^{st}$ level.

If the user executes step 200 through step 206 cyclically by illuminating the LED lamp 62 (light source will be changed to orange or red) to display a heating action of $2^{nd}$ or $3^{rd}$ level, then the power will be conducted and step 208 will be executed. At step 208, the power output from the power source 2 is transmitted to the heating unit 5 via the control unit 4, making the heating unit 5 to process a heating action on $2^{nd}$ or $3^{rd}$ level.

Owing to this multi-level heating design, the user is capable of adjusting the temperature of his wearing article in corresponding to the variation of water temperature when he is engaging a water activity.

Figure 5:
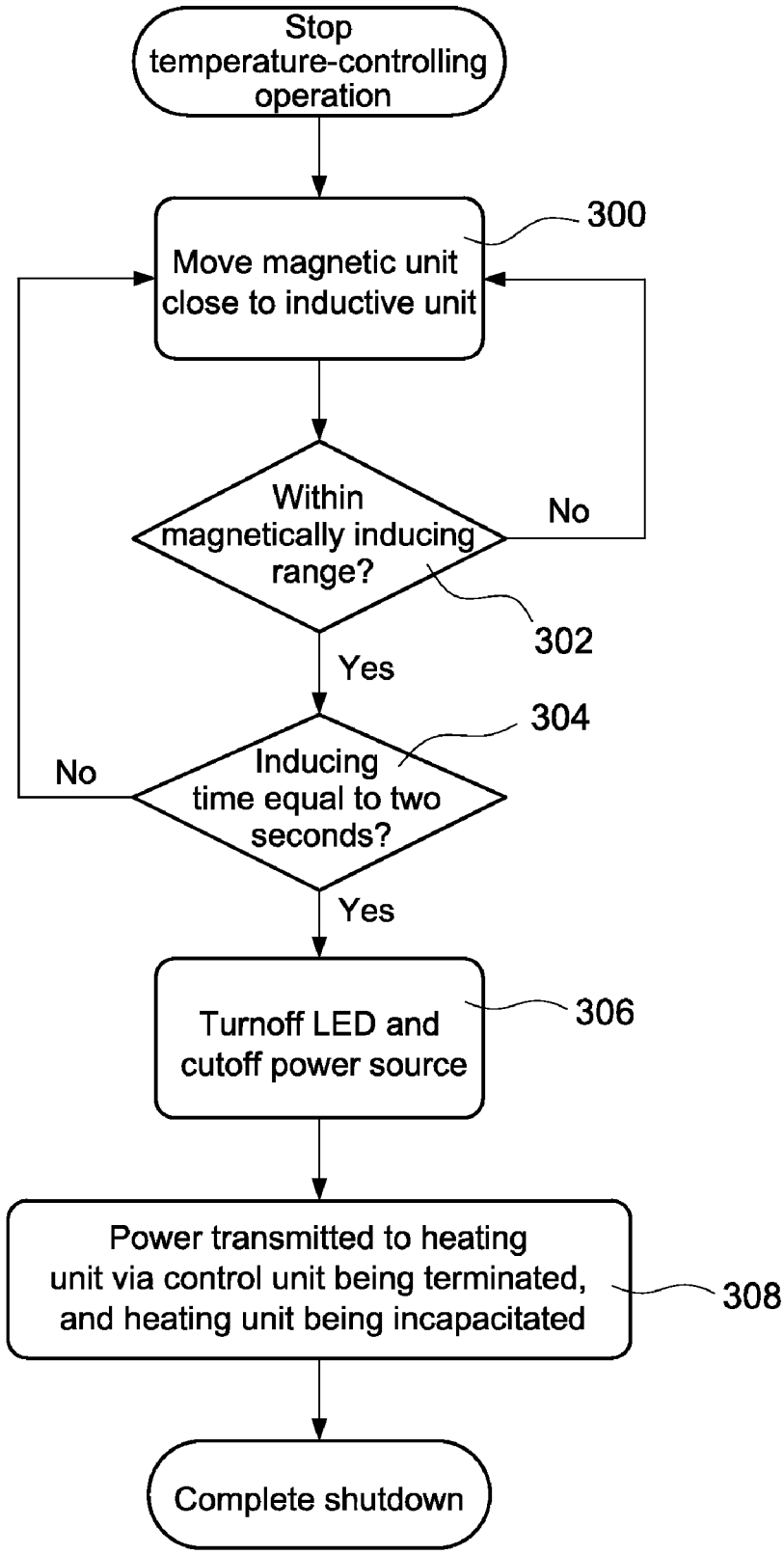
FIG. 5 is a heating flowchart illustration, when a heating unit is closed by the heating device according to the present invention.

Please refer to FIG. 5, which is a flowchart illustration showing the heating device according to the invention shutting down a heating procedure. In this case, FIG. 1 is cooperated herein for reference as well. When the user intends to stop the heating function of the heating device on the wearing article, as described in step 300, he needs to move the magnetic unit 1 toward the inductive unit 3. At step 302, whether the magnetic unit 1 is within the inducing range is determined. If the magnetic amount induced by the inductive unit 3 is too small (i.e., insufficient), then the procedure goes back to step 300. If the magnetic amount induced by the inductive unit 3 becomes bigger when the magnetic unit 1 is closing the inductive unit 3, then the procedure goes to step 304. At step 304, a time for the magnetic unit 1 to close toward the inductive unit 3 is determined whether it is equal to a third predetermined time (e.g., two seconds). If the answer is "yes", then the timer 41 in the control unit 4 will count two seconds, which will be compared to a preset time stored in the memory 42. If the inducing time is less than two seconds, then the procedure goes back to step 300. If the inducing time is equal to two seconds, then the procedure goes to step 306 to turnoff the LED lamp 61 (the light source is red). At this time, the power source is disconnected, and the procedure goes to step 308. At step 308, the power output from the power source 2 and transmitted to the heating unit 5 via the control unit 4 is terminated, thereby, to stop a heating action of the heating unit 5.

Figure 6:
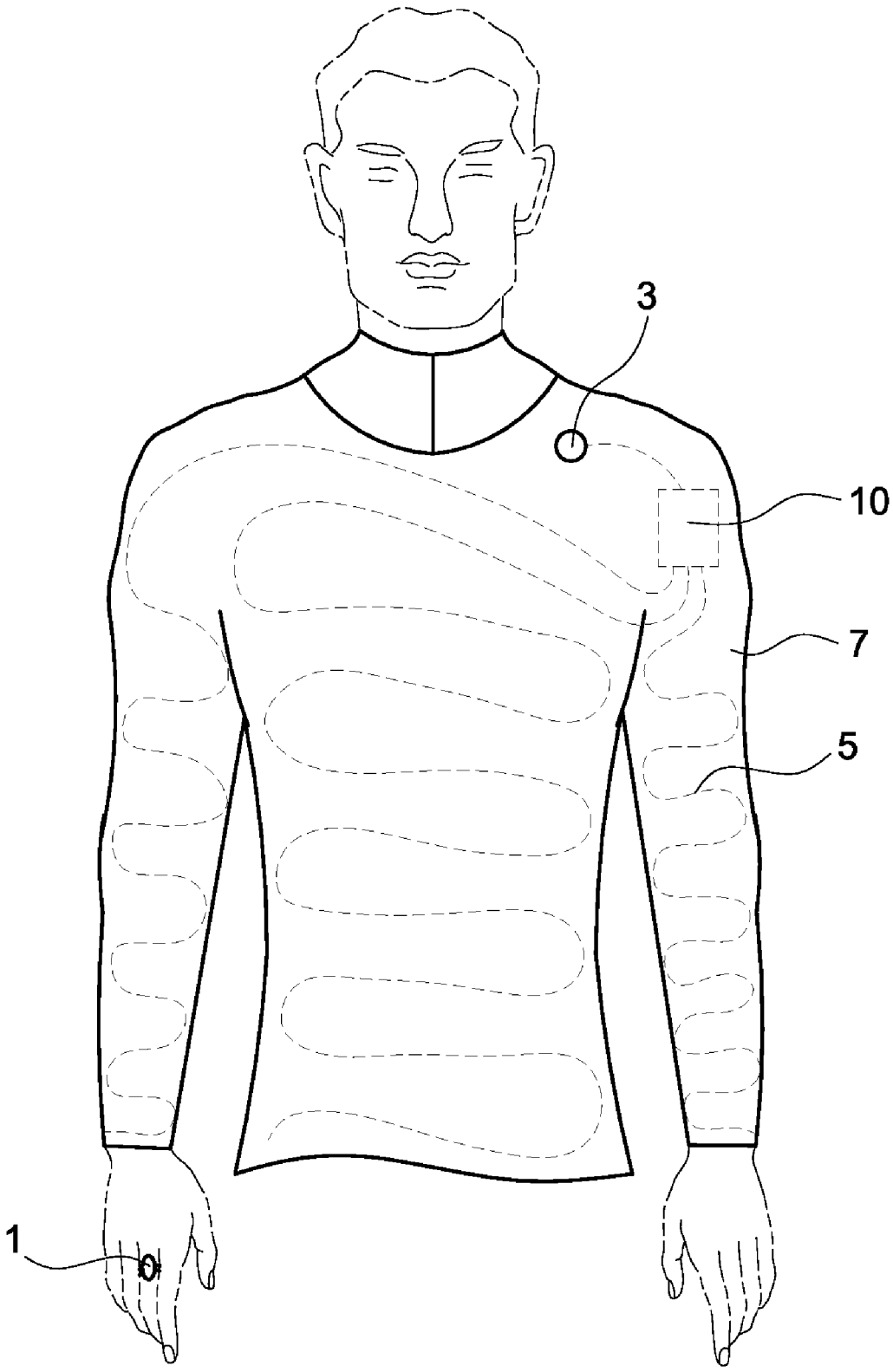
FIG. 6 is a using status illustration according to the present invention.

Please refer to FIG. 6, which is a using status illustration according to the present invention. As shown in this figure, when applying a heating device 10 of the invention, it is possible to arrange the heating device 10 and the heating unit 5 within a diving suit 7 with a inductive unit 3 explored outside the diving suit 7. In this case, the magnetic unit 1 may be worn on the finger of the diver or tied on the diving suit 7 with a rope. When the user intends to adjust the temperature of the diving suit 7, he just needs to move the magnetic unit 1 toward the inductive unit 3, making the inductive unit 3 capable to send a signal to the heating device 10 to actuate the heating unit 5 to process a heating, a temperature-adjusting, or a shutting-down action.

However, the aforementioned description is only a preferable embodiment according to the present invention, being not used to limit the patent scope of the invention, so equivalently structural variation made to the contents of the present invention, for example, description and drawings, is all covered by the claims claimed thereinafter.

What is claimed is:

1. A diving suit worn in water activities, comprising:

a magnet unit worn on a hand of a diver, arranged for generating a magnetic output;

a inductive unit exposed outside the diving suit, for sensing the magnetic output to generate an inductive signal as the magnet unit moves near to the inductive unit;

a control unit, electrically connected to the inductive unit for generating a control signal by receiving the inductive signal from the inductive unit, wherein a timer and a memory are arranged in the control unit, the timer being for counting a magnetism inducing time of the inductive unit, while a preset time is stored in the memory;

a heating unit arranged on the diving suit, electrically connected to the control unit, and driven by the control signal from the control unit to process a heating procedure;

a power source unit electrically connected to the control unit to provide a power source needed by the heating unit; and a multi-color display unit with a plurality of LEDs, electrically connected to the control unit, and driven by the control signal from the control unit to display an actuation and a shutdown of the heating unit, and a plurality of temperatures value of the heating unit in different colors by the LEDs, thereby the diver moves the hand near to the inductive unit to activate the heating device when the inductive unit first senses the magnetism inducing time in a first predetermined time and the display unit presents a first color, further activate the heating device when the inductive unit again senses the magnetism inducing time in a second predetermined time and the display unit presents a second color, and terminate the heating device when the inductive unit senses the magnetism inducing time in a third predetermined time and the display unit presents a third color.

2. The diving suit worn in water activities according to claim 1, wherein the inductive unit is a Hall inductive element.

3. The diving suit worn in water activities according to claim 1, wherein the control unit is a microprocessor.

4. The diving suit worn in water activities according to claim 1, wherein the heating unit is one kind of an electro-thermal wire, an electro-thermal filament, or an electro-thermal piece.

* * * * *